United States Patent [19]

Duport

[11] 3,973,405

[45] Aug. 10, 1976

[54] SURGE GENERATORS OF THE PLUNGER TYPE

[75] Inventor: Jacques Duport, St Ismier, France

[73] Assignee: Societe Generale de Constructions Electriques et Mecaniques (ALSTHOM), Paris, France

[22] Filed: Oct. 30, 1975

[21] Appl. No.: 627,407

[30] Foreign Application Priority Data

Nov. 20, 1974 France ..... 74.38166

[52] U.S. Cl. ..... 61/1 R; 4/172.16

[51] Int. Cl.[2] ..... E02B 3/00; A47K 3/10

[58] Field of Search ..... 61/1, 5, 19, 20; 4/172.16; 272/17; 73/148

[56] References Cited

UNITED STATES PATENTS

| | | | |
|---|---|---|---|
| 3,562,823 | 2/1971 | Köster | 61/1 R X |
| 3,789,612 | 2/1974 | Richards | 61/1 R |

FOREIGN PATENTS OR APPLICATIONS

| | | | |
|---|---|---|---|
| 140,854 | 5/1903 | Germany | 4/172.16 |

*Primary Examiner*—Jacob Shapiro

*Attorney, Agent, or Firm*—Sughrue, Rothwell, Mion, Zinn & Macpeak

[57] ABSTRACT

Improvements to surge generators of the plunger type for generating surge in a test tank, consisting in imparting to the said plunger a movement through an angle in relation to the vertical position.

1 Claim, 5 Drawing Figures

SURGE GENERATORS OF THE PLUNGER TYPE

DESCRIPTION OF THE PRIOR ART

Surge generators of the plunger type constituted by a body having a given shape and a vertical movement immersing it more or less in the expanse of water in which surge is required to be generated, are known.

One shape of plunger often used is that of a simple triangular prism with horizontal generating lines perpendicular to the direction of the surge to be generated and one of whose faces is vertical.

SUMMARY OF THE INVENTION

The present invention has as its object an improvement to surge generators of the plunger type, for generating surge with given characteristics in a test tank, consisting in imparting to the plunger a movement through an angle in relation to the vertical position, that angle being comprised between about 15° and 70°, the direction of the inclination being such that the low part of the path of the plunger is in front of the top part of that path, in relation to the direction of propagation of the surge emitted, the clearance between the lateral walls of the plunger and the corresponding walls of the test tank being slight.

The inclined movement is obtained, by the sliding of the rear face of the plunger on a inclined plane with a continuous wall, that rear face having the same inclination as the said inclined plane, the direction of the inclination being such that the lowest generating line is in front of the highest generating line in relation to the direction of propagation of the surge emitted.

The sliding of the rear face of the plunger on a continuous wall has the effect on the one hand of avoiding the detrimental effects of water leaks which would occur without that wall towards the rear of the plunger, namely, an agitation of the rear expanse of water with a parasite effect on the surge produced in front and a difference which is hard to calculate in the surge produced in relation to the surge which can be calculated in the arrangement according to the present patent and on the other hand to avoid the emission of a rear surge and thereby to limit the consumed power to a strict necessary minimum.

The front face can be plane or cylindrical, the lateral faces being plane, vertical and parallel to the directrix of propagation of the surge.

In the following part of this text, the continuous rear wall of the tank or of the generating device on which the rear face of the plunger slides will be designated as the ramp.

That ramp extends upwards up to a sufficient level for there to be in no case any overflowing of water over its upper generating line and downwards at least down to the lowest level reached by the lower generating line of the plunger in its extreme movements. If that level is above the bottom of the tank in which is installed the generator, the ramp is connected in a fluid-tight manner to the bottom of the tank and to the chamber walls, for example by a wall having a vertical facing. If, on the contrary, that level is situated below the bottom of the tank, it is necessary to provide a pit in front of the ramp, that pit being connected to the bottom as in the case of conventional wave-makers whose pivoting axis is situated below the level of the bottom of the tank.

The plunger moves parallel to the direction of the line of greatest slope of the ramp; at the time of the movement, the distance between the ramp and the rear face of the plunger is constant and relatively slight, as is the clearance between the lateral faces of the plunger and the chamber walls or the lateral guide vanes.

The movement of the plunger is a periodic movement; it is, for example, a harmonic movement or the resultant of several harmonic movements and the central point of that movement, defined by the mid point of the segment crossed by the point of the lower ridge of the plunger, can be chosen at any point defined for example by its dimension in relation to the average free surface, providing that, taking into account the amplitude of the movement, the condition of non-unwatering of the plunger and the condition of the extreme bottom position of the lower ridge of the plunger be satisfied.

The shape and the geometrical configuration of a surge generator according to the invention can be defined by the following characteristics:

The slope of the ramp and, consequently, of the linear movement of the plunger;

The shape and the position of the front face (for example the inclination in relation to the vertical position if that face is plane);

The end position which can be reached by the plunger;

It being assumed that the geometrical configuration of the plunger is defined, for example a triangular prism, the law of movement will be determined as a function of the surge to be generated.

To determine that movement, the central point can be chosen at random, within the limits permitted by the possible extreme positions of the plunger. The central point being chosen, the law of movement will be determined by calculation contingently combined with experimenting, for example on a reduced-scale model. The central point could be chosen as a function of the quality of the surge which results therefrom, or of the power necessary for moving the plunger, or of a combination of these criteria. The use of the free parameter constituted by the central point with a view to obtaining optimum performance of the generator is a characteristic common to generators of the plunger type, but the arrangement according to the invention, namely, the travel inclined in relation to the vertical position, increases the extent of the possible choice of the central point.

The inherent advantages of the arrangement according to the invention, which will clearly become apparent from the description with reference to the accompanying drawings, result from a better use of the movement of the plunger, resulting in a better quality of the surge produced and in a reduction of the losses of hydraulic energy.

The "useful volume" churned up by the movement of the plunger having an inclined travel, that is, the volume of water displaced by the latter in its movement, is greater than that of a plunger having a vertical movement, this resulting, for an equal horizontal linear movement, in a greater amplitude of the surge or, for a given amplitude, in a slighter horizontal linear movement.

On the other hand, the movement of water caused by a conventional plunger having vertical movement has the characteristic of a periodical but assymetrical movement.

This results in the emission of parasite movements of the water in relation to the ideal surge.

In the device according to the invention, the same unfavourable circumstance exists, but is limited to a very much smaller surface of water.

Another advantage resides in the fact that the arrangement according to the invention makes it possible to choose freely the inclination of the average line of the volume churned up by the plunger.

Indeed, with a conventional plunger having a vertical movement and in the case where the travel is limited at the bottom of the tank and at half the height of the water, a large inclination must be adopted for the front face and consequently for the average line which is the geometrical locus of the mid points of the horizontal paths, because of the horizontal movement. The result of this is a series of disturbances for the surge emitted because the movements imposed on the water which are, temporally, compulsorily in phase, are spatially staggered.

A vertical plunger arrangement in which the average line is less oblique than in the preceding example can be chosen, but this is obtained at a cost of an increase in the travel and the use of a fairly deep pit in front of the plunger.

In the device according to the invention, where the travel of the plunger is inclined, the average line is less oblique than in the two above-mentioned conventional examples, whereas the vertical travel is shorter and the use of a pit is avoided.

The advantages and characteristics of the invention will become apparent from the accompanying drawings showing, on the one hand, a conventional plunger having a vertical movement and, on the other hand, a plunger according to the invention having an inclined movement:

DESCRIPTION OF THE PREFERRED EMBODIMENTS

Figure 1:
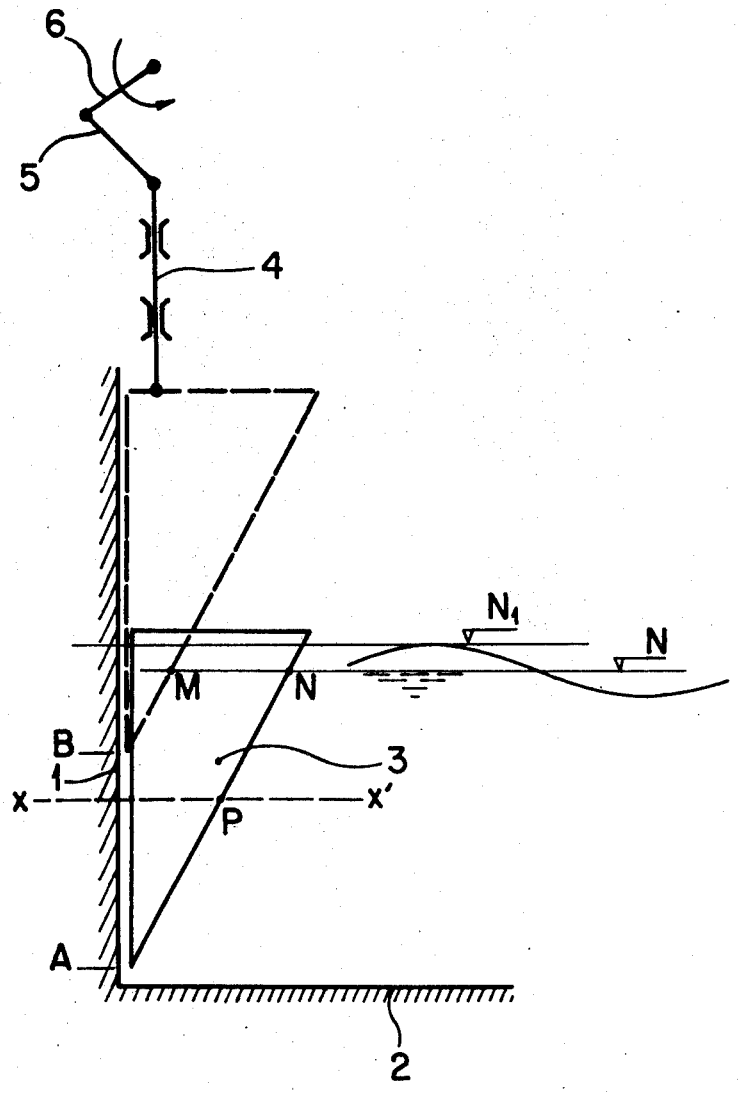
FIG. 1 (PRIOR ART)
FIG. 1 is a vertical cross-section view of a conventional plunger having a vertical movement.

FIG. 1 shows a test tank, in which a surge having given characteristics is required to be generated, with its rear wall 1 and its bottom 2, the average level of the water being shown by the reference N, the level of the highest waves being shown by the reference $N_1$.

The tank is equipped with a conventional surge generator of the plunger type 3 having the shape of a triangular prism, driven in a vertical upward and downward movement by means of a rod 4 actuated by a connecting rod 5 and a rotating arm 6.

Figure 2:
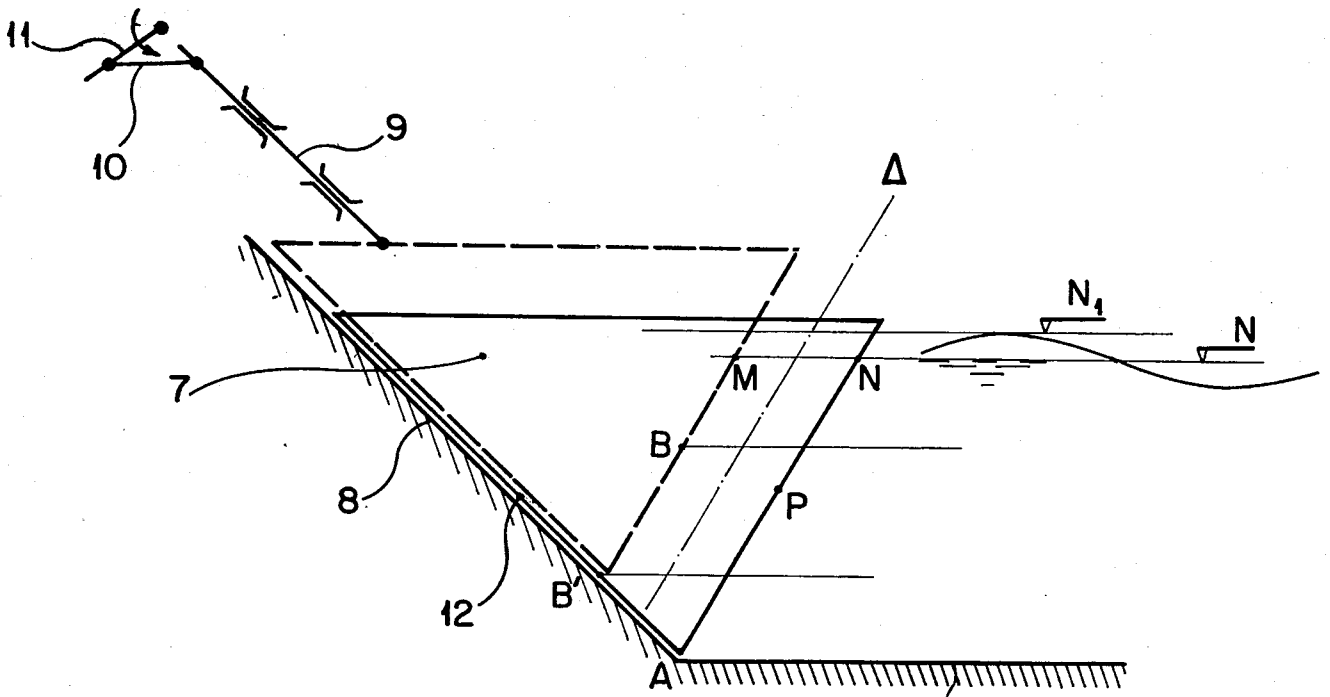
FIG. 2 is a partial vertical cross-section view of a plunger according to the invention, having an inclined movement.

FIG. 2 shows a surge generator according to the invention constituted by a plunger 7 having the shape of a triangular prism, moving in a direction which is inclined in relation to the bottom of the tank, that inclination, comprised between 15 and 70° in relation to the vertical position, being that of the rear wall 8 of the tank, that plunger still being partly immersed, its reciprocating movement being caused by a rod 9, a connecting rod 10 and a rotating arm 11.

The rear face 12 of the plunger moves along the rear wall 8 of the tank, hence parallel to the line of slope of that wall. During that movement, the distance between the face 12 and the wall 8 is constant and relatively slight, as is the clearance between the lateral faces of the plunger and the chamber walls of the tank.

The plunger having, in the example chosen, the shape of a triangular prism, the law of the movement will be determined as a function of the surge to be generated and to determine that movement, the central point P will be chosen within the limits permitted by the extreme possible positions of the plunger.

The advantages inherent to the arrangement according to the invention in relation to wave-makers having a vertical movement, become apparent from the comparison of the movement of the conventional plunger in FIG. 1 and that according to FIG. 2.

For the conventional plunger in FIG. 1, the "useful volume" churned up by the movement of the plunger 3, that is, the volume of water displaced by the latter in its movement from the high position (in discontinuous lines) to its low position, is shown by the prism whose cross-section is the quadrilateral ABMN.

For the plunger according to the invention in FIG. 2, the "useful volume" corresponding to the moment from the high position to the low position is shown by the quadrilateral AB'MN.

It will be seen that the volume corresponding to AB'B is gained, the result of this being, for an equal horizontal linear movement, a greater amplitude of the surge or, for a given amplitude, a slighter horizontal linear movement.

On the other hand, on considering, in FIG. 1, the horizontal layers of water comprised between the depth of the point A and that of the point B, it will be observed that the movement of the water caused by the conventional plunger has the characteristic of a periodic but assymetrical movement: for example, for the horizontal line XX', the wave-marker induces a movement of the water only while its lower generating line is below *xx'* and the result of this is the emission of parasite movements of the water in relation to the ideal surge.

In the device according to the invention, the same unfavourable circumstance exists but is limited to the very much smaller layer of water comprised between the depth of the point A and that of B'.

A comparison between FIGS. 1 and 2 also shows that the travel AB' of the plunger according to the invention is shorter than the travel AB of the conventional plunger. That reduction in travel being further increased by the fact that the horizontal linear movement necessary is itself slighter, as explained hereinabove.

Figure 4:
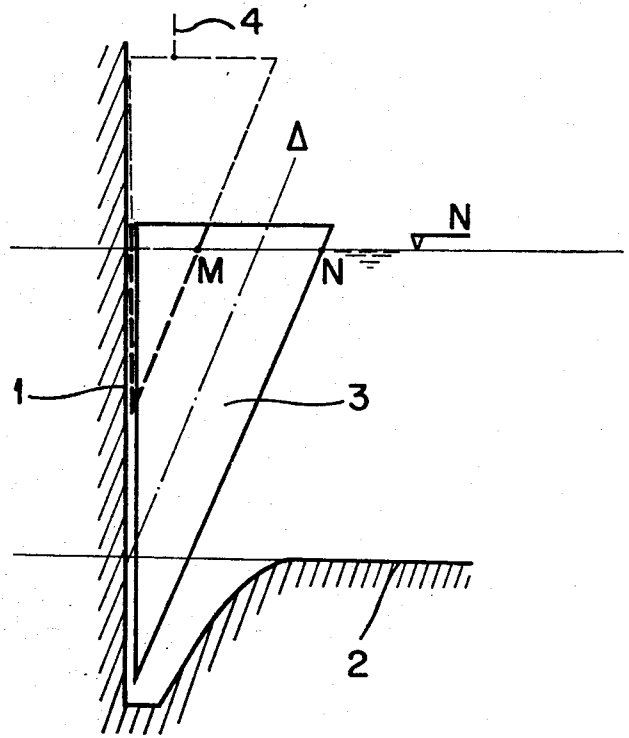
FIG. 4 (PRIOR ART)
FIG. 4 is a variant of the arrangement in FIG. 3.
Figure 3:
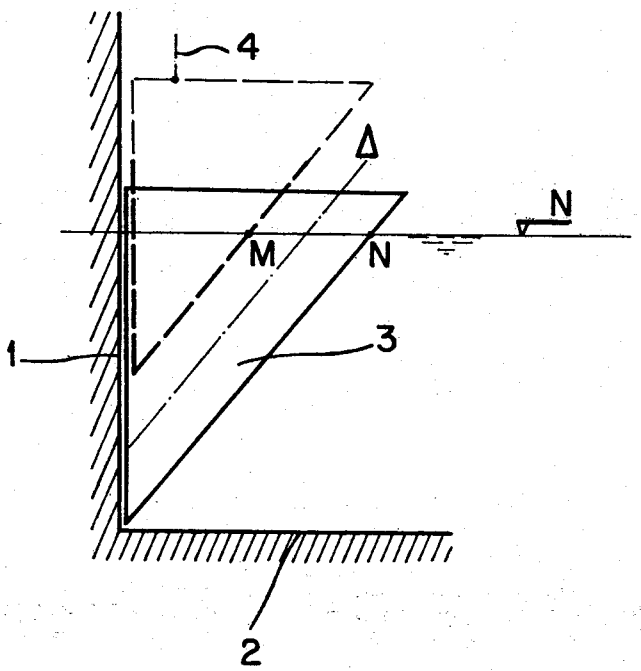
FIG. 3 (PRIOR ART)
FIG. 3 is a vertical cross-section view of a conventional plunger having a vertical movement showing the inclination of the centre line of the volume churned by the plunger.
Figure 5:
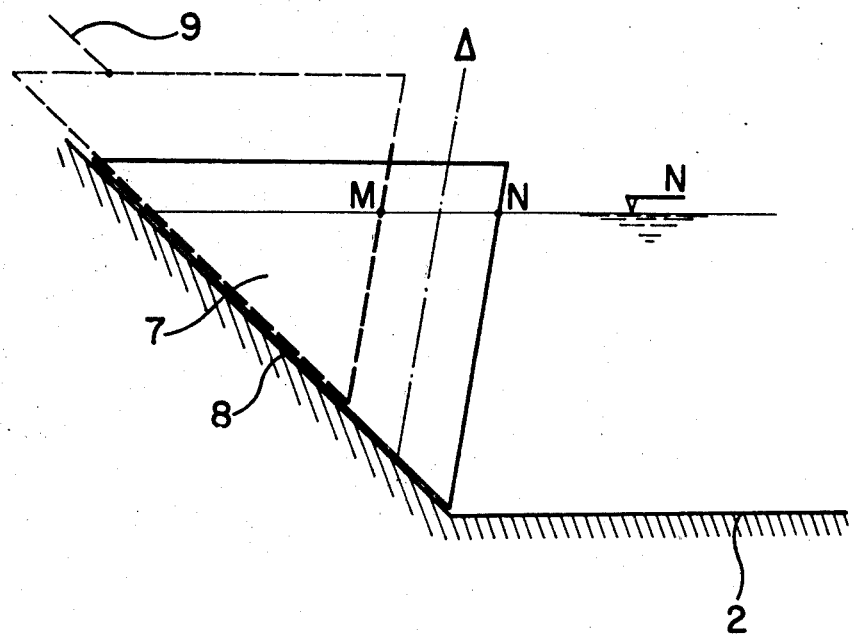
FIG. 5 is a vertical cross-section view of a plunger according to the invention, showing the inclination of the centre line of the volume churned up by the plunger.

Another advantage, illustrated in FIGS. 3, 4 and 5, resides in the fact that the arrangement according to the invention makes it possible to choose freely the inclination of the average line Δ of the volume churned up by the plunger.

In 3, 4 and 5, the amplitude MN of the horizontal paths imposed on the water by the plunger is the same. FIG. 3 shows a conventional plunger having a vertical movement whose travel is limited at the bottom of the tank and at half the depth of the water. Because of the relatively great amplitude of the horizontal movement MN, a great inclination of the front face and consequently of the line Δ which is the geometrical locus of central points of the horizontal paths, must be adopted. The result of this is a series of disturbances for the surge emitted because the movements imposed on the water which are necessarily temporally in phase, are spatially staggered.

FIG. 4 shows an arrangement of a vertical plunger in which the line Δ is less oblique than in the preceding example, but this is obtained at the cost of an increase in the travel and the use of a fairly deep pit in front of the plunger.

FIG. 5 shows an arrangement according to the invention; it is possible to observe that the line Δ is less oblique than in the two conventional arrangements, whereas the vertical travel is slighter and the use of a pit is avoided. The same type of advantage exists in the case where the front face is not plane.

I claim:

1. In a surge generator of the fluid-tight plunger type, for generating surge with given characteristics, and wherein a plunger is mounted for partial immersion within a liquid filled test tank, the improvement comprising means for limiting plunger movement through an angle in relation to the vertical position imparted to the plunger between about 15° and 70°, and wherein the direction of inclination is such that the low part of the path of the plunger is in front of the top part of that path, in relation to the direction of propagation of the surge emitted, said plunger is always partly immersed and takes the shape of a prism with horizontal generating lines perpendicular to the surge to be generated, the clearance between the lateral walls of the plunger and the corresponding walls of the test tank being slight, and wherein the inclined movement of the plunger is obtained by sliding of the rear face of the plunger on an inclinded plane with a continuous wall and the direction of the inclination of said plane being such that the lowest generating line is in front of the highest generating line in relation to the direction of propagation of the surge emitted.

* * * * *